US005476028A

United States Patent [19]

Seberger

[11] Patent Number: 5,476,028

[45] Date of Patent: Dec. 19, 1995

[54] GUN MUZZLE BRAKE

[76] Inventor: Oswald P. Seberger, P.O. Box 377, Shingletown, Calif. 96088

[21] Appl. No.: 330,593

[22] Filed: Oct. 28, 1994

[51] Int. Cl.[6] ..... F41A 21/36

[52] U.S. Cl. ..... 89/14.3

[58] Field of Search ..... 89/14.3, 14.4

[56] References Cited

U.S. PATENT DOCUMENTS

| | | | |
|---|---|---|---|
| 2,212,683 | 8/1940 | Hughes | 89/14 |
| 2,212,684 | 8/1940 | Hughes | 89/14 |
| 2,212,685 | 8/1940 | Hughes | 89/14 |
| 2,212,686 | 8/1940 | Hughes | 89/14 |
| 2,953,972 | 9/1960 | Sorensen | 89/14 |
| 2,963,943 | 12/1960 | Cutts | 89/14.3 |
| 3,455,203 | 7/1969 | Pillersdorf | 89/14 |
| 3,492,912 | 2/1970 | Ashbrook | 89/14.3 |
| 4,058,050 | 11/1977 | Brouthers | 89/14 C |
| 4,322,999 | 4/1982 | Aston | 89/14 C |
| 4,643,073 | 2/1987 | Johnson | 89/14.3 |
| 4,811,648 | 3/1989 | Blackwell et al. | 89/14.3 |
| 4,852,460 | 8/1989 | Davidson | 89/14.05 |
| 4,879,942 | 11/1989 | Cave | 89/14.3 |
| 4,930,396 | 6/1990 | Johnson | 89/14.3 |
| 4,930,397 | 6/1990 | Seidler | 89/14.3 |
| 4,945,812 | 8/1990 | Mazzanti | 89/14.3 |
| 5,020,416 | 6/1991 | Tripp | 89/14.3 |
| 5,092,223 | 3/1992 | Hudson | 89/14.2 |
| 5,225,615 | 7/1993 | Talbot et al. | 89/14.3 |
| 5,385,079 | 1/1995 | Cave | 89/14.3 |

*Primary Examiner*—Charles T. Jordan
*Assistant Examiner*—Theresa M. Wesson
*Attorney, Agent, or Firm*—A. M. Fernandez

[57] ABSTRACT

A concave surface at the front end of a gun facing the gun muzzle is tilted upwardly to redirect propelling gas rays to a venting port or ports adjacent the gun muzzle for virtual recoil neutralization. In the case of a single port at the top of the expansion chamber, not only axial recoil but also vertical recoil are virtually neutralized. In a dual-port arrangement, two ports (one on each side of a vertical plane through the axis of the expansion chamber) are provided with two concave surfaces tilted upwardly and outwardly to separately redirect rays of propellant gas through each of the two ports which are positioned with the extent of the area of each port above a horizontal plane through the axis of the expansion chamber determined empirically to provide neutralization of both vertical and horizontal recoil as well as axial recoil. Each concave surface for the dual-port arrangement is thus tilted up and to one side of the expansion chamber axis.

7 Claims, 3 Drawing Sheets

FIG. 2a
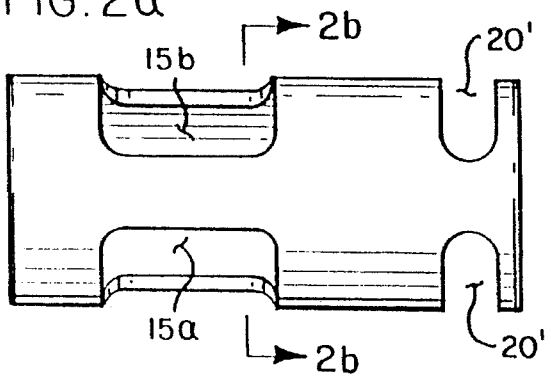
FIG. 2b
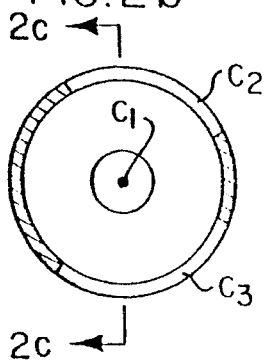
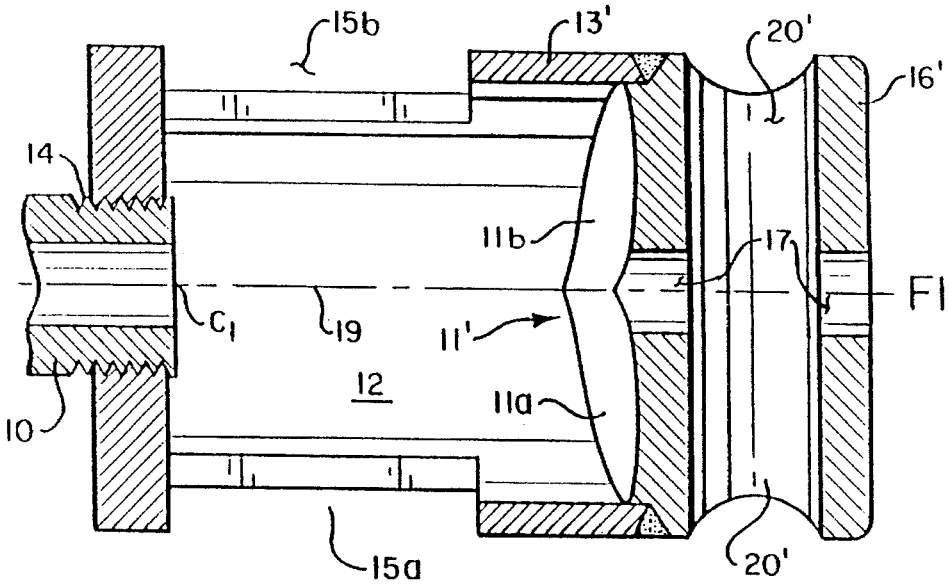
FIG. 2c
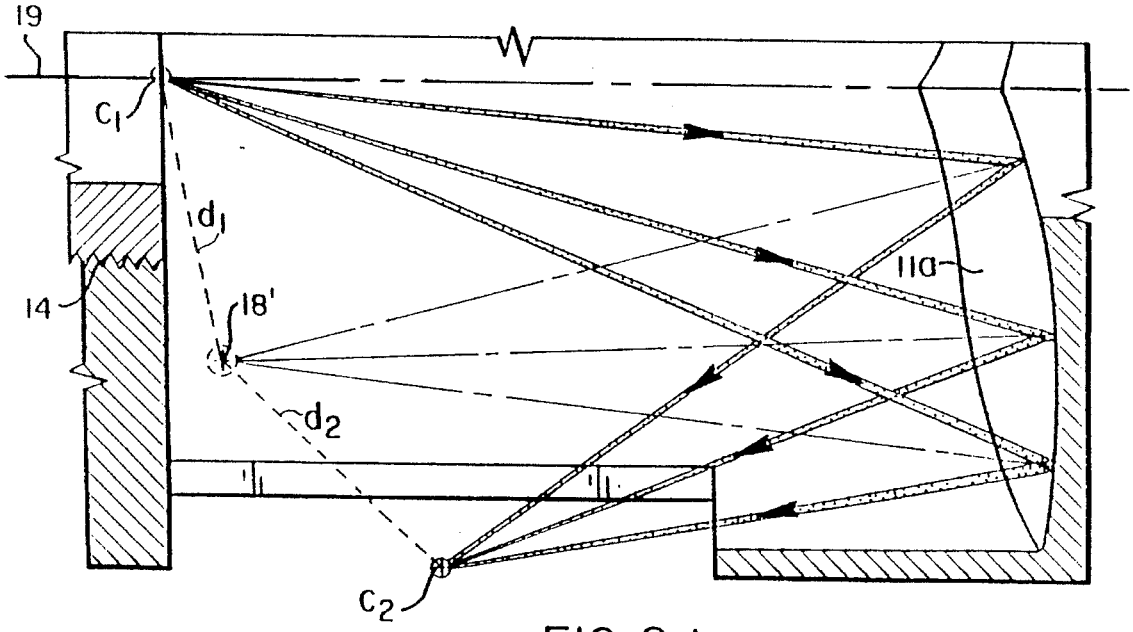
FIG. 2d

GUN MUZZLE BRAKE

FIELD OF THE INVENTION

The invention relates to a muzzle brake adapted to be axially secured to the muzzle of a gun of large or small caliber.

BACKGROUND OF THE INVENTION

The recoil of a gun severely interferes with the accuracy of firing at a target, particularly when using hand-held guns under rapid fire conditions, because the recoil of the gun tends to cause the muzzle to kick in a direction that depends largely upon the configuration of its stock, i.e., the wooden or metal part below the axis of the barrel. For example, a ground mobile antiaircraft or antitank gun will tend to kick up, lifting the gun carriage off the ground and thus cause it to change position in azimuth and/or elevation. Similarly, a hand-held gun, such as a pistol or rifle, will tend to kick up and often to one side, generally to the side away from the person holding the gun, making rapid semiautomatic fire at a target with accuracy of all but the first round impossible. Consequently, it is common practice to use two hands on the gun, including a pistol, but it is seldom that the person firing the gun is capable of absorbing the recoil equally in both arms, particularly a pistol, and so the gun will tend to kick to one side, even in the case of a rifle, unless held with the aid of some sturdy support to stabilize the gun barrel during recoil, not only because of the stock configuration but also because of the unsymmetrical disposition of the person's body relative to the gun. In an automatic weapon, this recoil problem is more severe since the barrel will kick incrementally with each firing cycle causing the gun to "walk" up and away from the target.

To overcome this recoil problem, attempts have been made for many years to provide a muzzle brake having an expansion chamber with a front annular surface or shoulder that is orthogonal to the muzzle axis to reverse the direction of expanding propellant gases and venting the gases through ports inclined rearwardly and outwardly as shown in U.S. Pat. No. 2,212,683, and possibly with similar ports ahead of the recoil controlling ports but inclined forwardly and upwardly to exhaust some expanding gases before they are reversed in direction to deflect propellant gases from ports that are reversed in direction away from the person firing the gun, as shown in U.S. Pat. Nos. 2,212,684, '685 and '686. See also U.S. Pat. Nos. 2,953,972, 4,811,648 and 4,852,460.

More complex arrangements have been developed for muzzle brakes in an attempt to stabilize the muzzle of a firearm and minimize the blast of reversed propellant gases against the person firing the gun, such as a muzzle brake having two expansion chambers with ports, a first expansion chamber with forwardly and upwardly directed ports and a second larger expansion chamber with a conical forward port at the front end for deflecting gases up through large upwardly directed slots orthogonal to the muzzle axis, as shown in U.S. Pat. No. 4,879,942. Another complex arrangement is shown in U.S. Pat. No. 4,930,396 comprising a series of tapered sections, each section having rings (annular rows) with ports having their axes orthogonal to the muzzle axis. U.S. Pat. No. 4,945,812 discloses a similar arrangement of multiple rings of ports but without the series of tapered sections. Instead, that arrangement relies upon ports in each ring (annular row) to form baffles that reduce recoil by directing propellant gases radially out through the ports.

An even more complex arrangement comprises a "flash hider" having a threaded bore that accepts the gun barrel at one end and a muzzle brake at the other. The end of the muzzle brake is screwed into the "flash hider" leaving a cavity between it and the gun muzzle, thus providing a small expansion chamber the forward end of which is an annular surface orthogonal to the muzzle axis. Five "retrojet channels" (ports) through the wall of the "flash hider" are inclined upwardly and rearwardly to reduce recoil and inhibit transverse movement of the gun muzzle, one at the top in a vertical plane, one on either side of the top, one in a plane 60° from the vertical, and another one on either side of the top one in a plane 120° from the vertical. The net effect of all retrojet channels at the rear of the muzzle brake is a rearwardly and downwardly directed force. In addition to that, the muzzle brake also has a "void" which forms a larger expansion chamber with a sloped face within the flash hider to direct expanding gases upwardly and rearwardly through elongated slots to counteract the natural tendency of the gun muzzle to kick upwardly and laterally.

Yet another prior-art arrangement shown in U.S. Pat. No. 5,225,615 comprises a gun barrel shroud having chamber in front of the gun muzzle with an inner diameter equal to the outer diameter of the gun barrel. The forward end of the chamber is capped by a disc having an exit orifice for the gun projectile to force expanding propellant gases to escape close to the capping disc through upwardly and rearwardly slanted (or slightly forwardly slanted) slots. Such an arrangement would be more suitable for guns of small caliber that exhibit less recoil but which still require some force to compensate the tendency of the gun to "walk" up under rapid firing conditions.

An objective of this invention is to provide an improved arrangement for a muzzle brake suitable for firearms of large and small caliber that not only neutralizes the tendency of the muzzle to kick back but also neutralizes any recoil forces that may cause the gun muzzle to kick upwardly and laterally.

SUMMARY OF THE INVENTION

In accordance with the present invention, a muzzle brake is provided as a coaxial extension of a gun barrel comprising a housing affixed to the end of the gun barrel. The housing has a gas expansion chamber with a concave rearward facing surface and at least one port through a sidewall for venting expanding projectile propelling gases. The concave surface is preferably a segment, i.e., is ideally shaped to be a precise segment of a sphere, or at least approximately shaped to be a segment of a sphere having a radial axis normal to the segmenting plane tilted upwardly such that the radial center of the segment is at a point within the expansion chamber that is ideally or at least approximately equidistant from the center of the gun muzzle and the center of the exhaust port in the wall of the expansion chamber.

In the case of a single venting port, the port is centered at the top of the expansion chamber in order to neutralize both the recoil and the upward kick of the gun barrel, i.e., to neutralize both the backward and upward forces on the gun barrel at the muzzle, as well as any lateral forces of the gun barrel.

In the case of dual exhaust ports, one on each side of a vertical plane through the muzzle brake axis, the forward end of the expansion chamber is provided with dual concave rearward facing surfaces, one on either side of the vertical plane passing through the muzzle brake axis, each surface being a segment of a hemisphere having a radial axis normal to the segmenting plane tilted upwardly and outwardly such that the radial center of the segment is at a point within the expansion chamber equidistant from the center of the gun muzzle and the center of the venting port on the same side of a vertical plane through the muzzle brake. The centers of the ports are spaced equally from the vertical plane at a selected angle from the vertical plane approximately equal to 90°±Δ, where the sign and magnitude of Δ is determined empirically for the particular gun to be equipped with the muzzle brake. The radial centers of the dual spherical segments are at points within the expansion chamber that are equidistant from the center of the gun muzzle and the centers of the venting ports on the same side of the vertical plane through the muzzle brake axis as the spherical segments, thereby neutralizing axial recoil forces of the gun barrel as well as both lateral and vertical forces on the gun barrel.

In the case of more than two exhaust ports, a spherical surface is provided for each port that is ideally the shape of a segment of a sphere with its radial center equidistant to the center of the muzzle and the center of the exhaust port to which the spherical center is to redirect propelling gases, such as three venting ports, one venting port centered at the top of the expansion chamber and two venting ports spaced at equal angles from a vertical plane through the muzzle brake axis.

More than three exhaust ports may be similarly provided. For example, many exhaust ports may be spaced completely around the expansion chamber in a ring, or even in two or more rings with venting ports in each ring displaced relative to any adjacent ring to space the centers of the venting ports even with webs between venting ports of any adjacent rings. That arrangement provides equidistant spacing between any three adjacent ports of the rings everywhere around the axis of the muzzle brake. In that case, the concave surface may, in practice, be provided as an annular concave surface having a cross section in every plane passing perpendicularly through the axis of the muzzle brake that is a segment of a circle the radial center of which is positioned equidistant from the center of the gun muzzle and the average center of the ports in the cross section of the annular concave surface.

The novel features that are considered characteristic of this invention are set forth with particularity in the appended claims. The invention will best be understood from the following description when read in connection with the accompanying drawings.

BRIEF DESCRIPTION OF THE DRAWINGS

FIGS. 1*a* through 1*h* illustrate various views of a first embodiment of a muzzle brake of the present invention in which FIG. 1*a* is a top view, FIG. 1*b* is an end view from the front (right of FIG. 1*a*), FIG. 1*c* is an end view from the rear (left of FIG. 1*a*), FIG. 1*d* is a cross section taken on a center line 1*d*—1*d* of FIG. 1*a*, FIG. 1*e* is a cross section taken on a line 1*e*—1*e* in FIG. 1*a*, and FIG. 1*f* is a rear end view useful in understanding the orientation of FIG. 1*d*. FIG. 1*g* illustrates a cross section of the two parts of the assembled gun muzzle brake before being joined and welded together as shown in FIG. 1*d*. FIG. 1*h* is an enlarged view of FIG. 1*d* in which geometry of a segment of a spherical surface of radius r is shown in the front baffle position of the muzzle brake in relation to the center of the gun muzzle and the center of the single top venting port.

FIGS. 2*a* through 2*d* illustrate a second embodiment of the invention that is similar to the first embodiment except that instead of a single venting port at the top of an expansion chamber there are two side ports as illustrated in FIG. 2*a*, a top view, which corresponds to the view in FIG. 1*a* of the first embodiment, and in FIG. 2*b* which shows a cross section taken on a line 2*b*—2*b* in FIG. 2*a*. FIG. 2*c* shows a cross section of the device in FIG. 2*a* taken on a line 2*c*—2*c* indicated in FIG. 2*b* but actually taken on FIG. 2*a*.

DESCRIPTION OF PREFERRED EMBODIMENTS

Figure 1C:
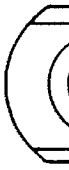
Figure 1A:
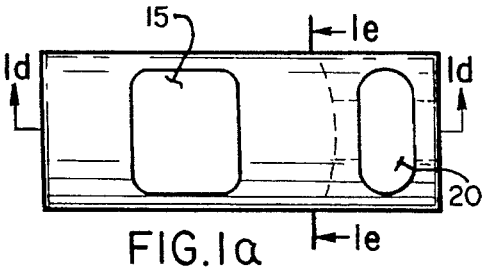
Figure 1B:
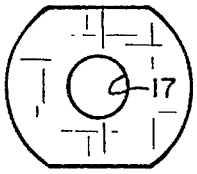
Figure 1F:
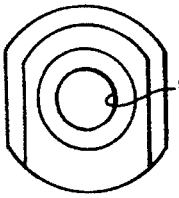
Figure 1D:
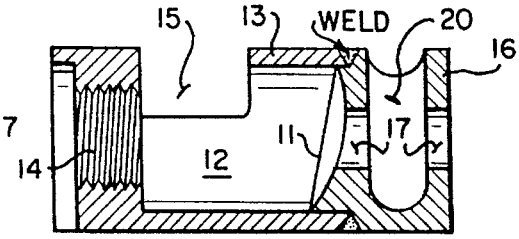
Figure 1E:
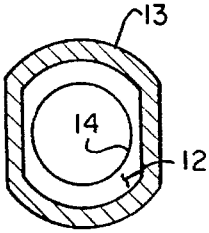
Figure 1G:
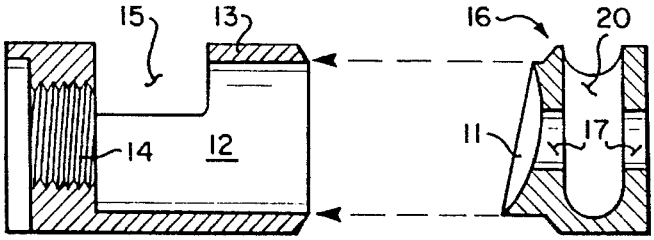
Figure 1H:
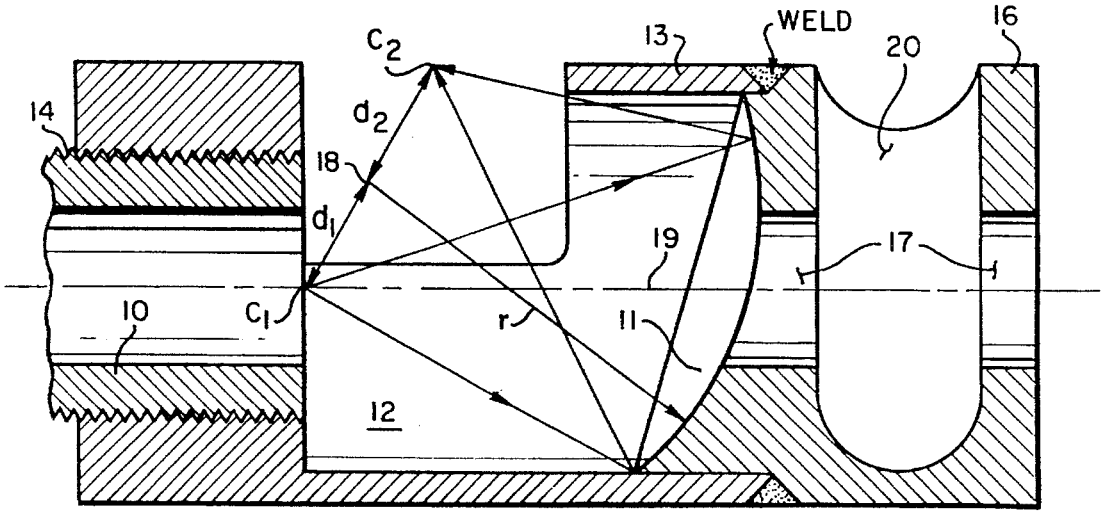

In the first embodiment of the invention illustrated in FIGS. 1*a* through 1*h*, the main propulsion gas from a gun barrel 10 (shown in FIG. 1*h*) strikes a concave baffling surface 11 in an expansion chamber 12 of the muzzle brake 13 coaxially secured by machined threads 14 on the end of the gun barrel in order to deflect the propulsion gases back toward a port 15 in the wall of the expansion chamber, thereby producing a forward reaction force approximately equal to the recoil of the gun discharge when it is fired. The concave baffle 11 is ideally formed by machining a segment of a spherical surface in an end disk 16 having a bore 17 aligned with the axis of the gun barrel 10 as shown in FIG. 1*h*. The end disk 16 is machined separately, then combined as shown in FIG. 1*g* and welded to the muzzle brake 13 as shown in FIG. 1*d*. To machine the concave surface 11, the end disk 16 is fixed in the machining mill such that the radial center 18 of the spherical segment to be formed is at a point that will lie within the expansion chamber 12 and is equidistant ($d_1=d_2$) from the center $C_1$ of the gun muzzle (the end of the gun barrel 10) and the center $C_2$ of the venting port 15 in the wall of the expansion chamber 12. The concave surface 11 will then reflect propulsion gases from the gun muzzle to the venting port 15, as shown in FIG. 1*h* for gases expanding from the center $C_1$ of the muzzle along two possible lines for the reflected gases to converge at the center $C_2$ of the port.

It is recognized that propulsion gases may begin expanding from other points further into the gun barrel 14 and from points off the gun barrel or muzzle axis 19 so that it should be understood that the two rays of propulsion gases shown in FIG. 1*h* are intended to be illustrative and not definitive; reflected rays from the other points in the muzzle and further back into the gun barrel would be incident on the concave surface at other points and be reflected along different paths to emerge from the port at different points, but the main port of the expanding propulsion gas energy will pass through the port which is extended over almost half of the cylindrical wall of the expansion chamber and centered at the top.

The propulsion gases not reflected by the concave surface 11 are then directed to the atmosphere through a porting system comprising one or more ports in the disk 16, such as a single port 20 centered on a vertical plane passing through the muzzle brake axis, or dual ports, one to each side of the vertical plane that are centered on or slightly above a horizontal plane passing through the muzzle axis, as shown for the second embodiment in FIGS. 2*a* and 2*c*. As expanding and reflected gas rays reach the area adjacent to the port 15, they are intersected by newly emerging main discharge gas rays from the gun muzzle, but these will merely enhance the venting of propulsion gases with greater velocity since the emerging rays will have more energy than the reflected rays.

The force of the main discharge gases that have been reflected by the concave surface 11 in the expansion chamber 12 impart a certain amount of forward and downward energy to the barrel of the gun, the downward force on the barrel depending on the radius of the spherical segment formed for the concave surface 11 and the position of the sphere center. In that manner, the initial recoil generated by the propulsion gases accelerating a projectile down the bore of the gun barrel are counteracted by the propulsion gas rays reflected by the concave surface 11 thus neutralizing axial recoil thrust. Since these rays are reflected rearwardly and upwardly, there is a portion of the propulsion gas energy that is used to apply a downward force on the end of the gun, thus neutralizing the upwardly directed force of the axial recoil thrust that tends to cause the gun barrel to kick or rise up when the gun is fired. The port must have an area adequate to vent the combined deflected gases and emerging main propelling gases.

In the case of dual venting ports 15*a* and 15*b* illustrated in FIGS. 2*a* through 2*d*, the concave surface 11 of the first embodiment comprises two concave surfaces 11*a* and 11*b* at the front end of the muzzle brake expansion chamber 12. The two venting ports are located at the rear of the expansion chamber. Each concave surface is ideally shaped as a segment of a spherical surface with its radial axis at a point 18' equidistant ($d_1=d_2$) to the center $C_1$ of the gun muzzle and the center $C_2$ of the venting port on the same side of a vertical plane through the barrel and muzzle brake axis 19.

This dual-faced (concave) surface 11' (comprising concave surfaces 11*a* and 11*b*) is inclined from the vertical (tilted up) so that the top edge of the surfaces 11*a* and 11*b* are further from the gun muzzle than the bottom edge as shown in FIG. 2*c* to assure impinging propulsion gases are reflected at a positive angle with respect to a horizontal plane. The main propulsion gas rays striking the inclined dual-faced surface 11' imparts a downward force on the muzzle as well as a forward force in a manner similar to the single port muzzle brake of FIGS. 1*a* through 1*h* but with two ports 15*a* and 15*b*, the extent to which a downward force is imparted on the gun barrel may be empirically designed by simply adjusting the centers of the ports 15*a* and 15*b* up or down equally and machining the concave surfaces 11*a* and 11*b* in the same manner as before, resulting in the concave surfaces being tilted up more the further the port centers are moved up, i.e., the higher the port centers are above a horizontal plane through the axis 19 of the muzzle brake. In that manner, the gases deflected by the dual-faced surface 11' are directed rearwardly and upwardly on each side of a vertical plane through the axis 19. The reflected gas rays combine with the following emerging main propulsion gas rays and are deflected in a direction almost orthogonal to the gun muzzle axis and at an upward angle from a horizontal plane through the muzzle brake axis.

The venting system for such a dual-faced surface 11' has a hole at either side of the expansion chamber with the rearward edges thereof near the gun muzzle. The ports are disposed on the sides of the main chamber and centered on or slightly above a horizontal plane passing through the axis of the muzzle. The ports must have an area adequate to vent the combined deflected gases and emerging main discharge gases.

In an extension of the present invention beyond dual ports, such as three ports by combining the single port with the dual port arrangement, the spherical baffling surface for the top venting port 15 would first be machined. The spherical surfaces for side venting ports 15*a* and 15*b* would then be machined by simply reorienting the cutting tool, first to one side and then to the other. A fourth venting port opposite the top port 15 could also be added. In that case, the baffling surface for the fourth port would be machined last. The baffling surfaces for the ports 15, 15*a* and 15*b* would be tilted as before. However, by adding a bottom port, the effect of neutralizing the tendency of the muzzle to kick upwardly is greatly reduced if not virtually canceled. However, by moving the centers of the side ports 15*a* and 15*b* further up from a horizontal plane through the muzzle brake axis, some of that neutralizing effect on forces that may cause the gun muzzle to kick upwardly and laterally may be retained, if desired, while maintaining the top port 15 and the opposite (fourth) port centered on a vertical plane through the muzzle brake axis.

Figure 3:
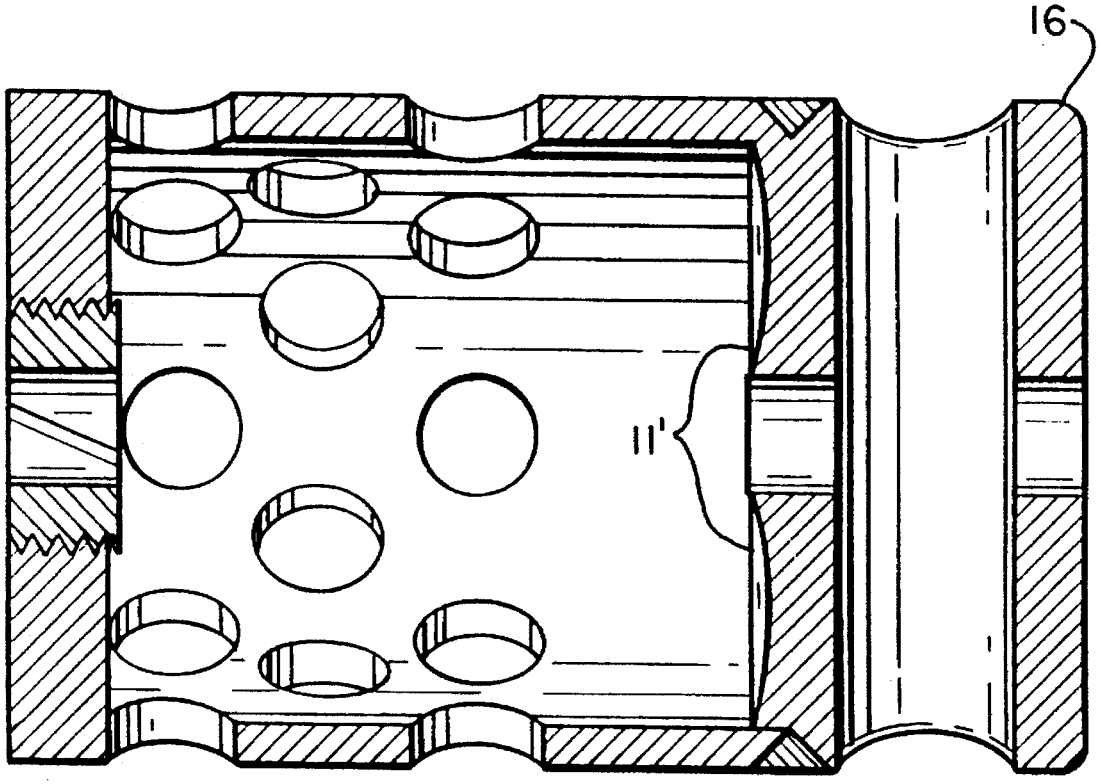
FIG. 3 illustrates in an axial cross section another embodiment having an annular concave surface for redirecting propellant gas rays through a multiplicity of venting ports in rings around the expansion gas chamber.

A number of ports greater than 3 or 4 may be similarly provided around the expansion chamber as shown in FIG. 3. The sizes of the venting ports must necessarily be adjusted to leave sufficient web between ports to support the disk on which the spherical baffling surfaces are cut. To accomplish the machining of the baffling surfaces for a large number of venting ports significantly greater than 3 or 4, the resulting concave surfaces machined on the end disk 16 will approach an annular concave surface 11 in which case the orientation of the cutting tool would remain the same while the end disk 16 being cut is gradually rotated about its axis. By continuing to machine the concave surface through at least one full rotation of the disk 16, the result is an annular concave surface which at every radial cross section will have a spherical shape with the radial center between the muzzle center and the expansion chamber wall and equidistant from the muzzle center and a line through the average center of the ports.

Thus, after so cutting the annular concave surfaces while the end disk is turned on its axis, it will have an annular surface that is the shape of a true spherical segment at every radial cross section with the radial center of the segments at a point within the expansion chamber that is equidistant from the center of the gun muzzle and an annular line passing through the center of the ports in the center ring if the number of rings is odd and between the two center rings if the number of rings is even.

While it would be possible to place a single ring of rectangular ports around the expansion chamber next to the muzzle for optimum port venting and greater strength of the web between the ports, the ring of ports may consist of a first ring of smaller circular ports and two additional rings of circular ports with their centers offset as shown in FIG. 3. In practice, circular ports of smaller diameter may be used by adding additional rings of ports, such as a fourth and fifth. The annular line through the centers of the ports in the center ring in the case of an odd number of rings (or through the center of the web between the central two rings in the case of an even number of rings) will then be the "center of the port" at a cross section taken anywhere in a radial plane passing through the muzzle brake axis. The result is a muzzle brake in which the reaction of propulsion impinging gases against the baffling surface will neutralize virtually all of the recoil of the gun, and any tendency of the muzzle to kick upwardly and laterally will be minimized to the point where the person firing the gun will likely be able to hold the gun aimed on the target from round to round, even with an automatic weapon.

Thus, the baffling surface for a multiplicity of venting ports in a ring or rings may comprise an annular concave surface inscribed with its radial center at a point between the center of the gun muzzle and the average center of the venting ports. At every radial cross section, the concave surface is tilted out away from the muzzle axis to direct deflected propulsion gases rearwardly and outwardly. The porting system is located on the wall of the expansion chamber proximate the muzzle.

Theory and Design

The length and width of the muzzle brake body and the location and width of the venting port system are determined by several factors:

The amount of recoil reduction desired is determined by the surface area of the formed baffle, which is limited by dimensions of the body.

The length of the bullet and the length of the portion of the bullet that has a full diameter profile.

The bullet and gas velocities.

The theory of design of the muzzle brake is as follows: As the projectile emerges from the end of the gun muzzle and enters the body of the muzzle brake, the main discharge gas which has a greater velocity than the projectile velocity begins to overtake the projectile. Before the main discharge gas passes the projectile, the projectile blocks the centrally located bore in the formed baffling surface. For optimum performance, the projectile should begin to block the centrally located bore at the time that the main discharge gas reaches the forward part of the cylindrical section of the projectile. The pressure continues to increase during the time that the centrally located port is blocked by the projectile.

The longer the duration in time that the high pressure of the main discharge gas exerts a force on the formed baffle, the greater is the forward force exerted on the formed baffling surface by the gas to neutralize recoil. The formed baffling surface is shaped so that the main discharge gas striking the formed baffling surface is deflected rearwardly toward the port venting system. The energy level of the deflected gas is considerably less than the energy level of the main discharge gas. The deflected gas is intersected by the outward expanding, newly emerging, main discharge gas, and the two combine to exit the body through the port system in a direction approximately perpendicular to the muzzle axis.

The location of the forward part of the port system is determined by the dispersion of the main discharge gas from the gun muzzle. The sound power level (SPL) measurements and shadow graph pictures taken at various positions, with the position directly in front of the muzzle being designated 0° and the position normal to the muzzle axis being designated 90°, indicate the following: the sound and gas patterns are quasi-spherical with the intensity at 90° being one half the intensity at 0°. It is assumed that the intensity at 45° would be three quarters the intensity at 0°. The forward part of the port venting system must be positioned close enough to the gun muzzle so that a major portion of the main propellant gas is directed towards the formed baffling surface and not into the atmosphere through the port venting system. The greater the length of the projectile the longer the distance that the forward section of the port venting system can be from the gun muzzle. The port venting system must be long enough to allow the deflected gases and the newly emerging main discharge gases to combine and exit the expansion chamber.

The formed baffling surface must be positioned close enough to the gun muzzle so that the high energy component of the main discharge gas impinges directly on the formed baffling surface and is not bounced from the side of the body onto the baffling surface at so great an angle that the flow pattern from the formed baffling surface is distorted and the deflected gas is not directed to the port venting system.

The desired gas flow pattern for maximum efficiency is such that the high energy component of the main propellant gas ray exerts a forward force when it strikes the formed baffling surface, and the deflected gas ray is directed towards the port system where it is intersected by the newly emerging main discharge gas ray. The two intersecting gas rays combine and the resulting ray is directed to the atmosphere through the port venting system while the newly emerging main propellant gas flow continues to exert a forward force on the formed baffling surface until the following emerging main gas energy drops to near zero.

In summary, a muzzle brake is provided with a cylindrical expansion chamber having a concave surface at the front end facing the muzzle and tilted upwardly to redirect propelling gas rays to a venting port or ports adjacent the muzzle. In a single venting port arrangement, the port at the top of the expansion chamber not only allows for axial recoil to be neutralized but also any vertical and horizontal forces on the muzzle due to recoil. In a dual-port arrangement, two ports (one on each side of the expansion chamber) are placed with their centers equally spaced above a central horizontal plane, and a concave surface is provided for each port to redirect rays of propellant gas through the dual ports. Each concave surface is tilted up and to one side of a central vertical plane. An arrangement of three ports may be provided by combining the single port arrangement with a dual-port arrangement, each port with its own tilted concave surface on a portion of a front end disk, and an arrangement of four ports may be provided by combining a fourth port (with its own concave surface) at the bottom opposite the top port.

To enhance recoil neutralization, the position of the dual ports on the sides may be empirically determined to optimize neutralization of any vertical and horizontal forces on the muzzle due to recoil. For maximum neutralization of recoil, a multiplicity of ports may be provided in a ring or rings near the muzzle, in which case the concave surfaces provided for redirecting rays of propellant gas through the ports approaches an annular concave surface with the same shape at every radial cross section not unlike that for each of the dual ports, except that each of the dual ports would become one of a succession of overlapping groups of smaller offset ports or one of a succession of overlapping clusters of smaller offset ports in a ring (annular band) around the expansion chamber.

I claim:

1. A gun muzzle brake having an axis, said gun muzzle brake being adapted to be affixed to a muzzle of a gun barrel as a coaxial extension thereof comprising a housing having an aperture for receiving said gun muzzle, said housing having a gas expansion chamber coaxial with said gun barrel axis and with a rearward-facing concave surface at the forward end thereof, and at least one exhaust port through a side wall proximate said gun muzzle for venting expanding propelling gases, said concave surface being shaped to be a spherical segment taken of a sphere at a plane through said sphere, said spherical segment having a radial axis normal to said plane tilted away from said axis of said muzzle brake such that a radial center of said spherical segment is at a point within said expansion chamber that is approximately equidistant from the center of said gun muzzle and the center of said exhaust port in said side wall of said expansion chamber.

2. A muzzle brake as defined in claim 1 having a single exhaust port, said single exhaust port being centered at the top of said expansion chamber in order to neutralize both axial and vertical recoil of said gun barrel.

3. A muzzle brake as defined in claim 1 having dual exhaust ports proximate said gun muzzle, one on each side of a vertical plane through said axis of said muzzle brake, and said forward end of said expansion chamber being provided with dual concave rearward facing surfaces, one on each side of said vertical plane through said axis of said muzzle brake, each concave surface being a spherical segment taken of a sphere at a plane through said sphere, said spherical segment having a radial axis normal to said plane tilted upwardly and outwardly such that a radial center of said spherical segment is at a point within said expansion chamber equidistant from the center of said gun muzzle and the center of said exhaust port on the same side of said vertical plane through said axis of said muzzle brake.

4. A muzzle brake as defined in claim 3 wherein said centers of said exhaust ports are spaced equally from said vertical plane through said axis of said muzzle brake at a selected angle approximately equal to $90°\pm\Delta$, where the sign and magnitude of $\Delta$ is determined empirically for the particular gun to be equipped with said muzzle brake to neutralize axial and both vertical and horizontal recoil of said gun muzzle.

5. A muzzle brake as defined in claim 4 wherein radial centers of said dual spherical segments are at points within said expansion chamber equidistant from said center of said gun muzzle and centers of said exhaust ports on the same side of said vertical plane through said axis of said muzzle brake as the spherical segments.

6. A muzzle brake as defined in claim 1 having more than two exhaust ports and a spherical surface provided for each exhaust port that is the shape of a segment of a sphere with its radial center equidistant to the center of said gun muzzle and the center of said exhaust port to which said spherical surface for each exhaust port is to redirect propelling gases, with one exhaust port centered at the top of said expansion chamber, and two exhaust ports spaced at equal angles from said vertical plane through said axis of said muzzle brake.

7. A muzzle brake as defined in claim 1 having a multiplicity of exhaust ports spaced completely around said expansion chamber in one or more rings with exhaust ports in each ring displaced relative to any adjacent rings to evenly space centers of said exhaust ports with webs between exhaust ports of any adjacent rings, and wherein said concave surface is provided as an annular concave surface having a cross section in every plane passing perpendicularly through said axis of said muzzle brake that is a segment of a circle the radial center of which is positioned equidistant from the center of said gun muzzle and the average center of said exhaust ports in the cross section of said annular concave surface.

* * * * *